US008794727B2

(12) United States Patent
Thomson et al.

(10) Patent No.: US 8,794,727 B2
(45) Date of Patent: Aug. 5, 2014

(54) MULTIPLE PRINT HEAD PRINTING APPARATUS AND METHOD OF OPERATION

(75) Inventors: Christopher Thomson, Etobicoke (CA); Jeffrey Belbeck, Mississauga (CA); Robert McCallum, Caledon (CA); Theodore Bellisario, Cheltenham (CA)

(73) Assignee: Delphax Technologies Inc., Bloomington, MN (US)

( * ) Notice: Subject to any disclaimer, the term of this patent is extended or adjusted under 35 U.S.C. 154(b) by 159 days.

(21) Appl. No.: 13/368,280

(22) Filed: Feb. 7, 2012

(65) Prior Publication Data

US 2013/0201237 A1 Aug. 8, 2013

(51) Int. Cl.
*B41J 29/38* (2006.01)

(52) U.S. Cl.
USPC ..... 347/14; 347/9; 347/104; 347/16; 347/19

(58) Field of Classification Search
CPC ..... B41J 29/38
See application file for complete search history.

(56) References Cited

U.S. PATENT DOCUMENTS

| | | | | |
|---|---|---|---|---|
| 6,079,814 | A | 6/2000 | Lean et al. | |
| 7,396,123 | B2 * | 7/2008 | Sootome et al. | 347/104 |
| 7,422,319 | B2 * | 9/2008 | Saito et al. | 347/104 |
| 7,837,320 | B2 * | 11/2010 | Mohri et al. | 347/104 |
| 2001/0028381 | A1 * | 10/2001 | Kashiwagi et al. | 347/104 |
| 2007/0268351 | A1 | 11/2007 | Ageishi | |
| 2010/0021219 | A1 * | 1/2010 | Hori | 399/388 |
| 2010/0118099 | A1 * | 5/2010 | Ito | 347/104 |
| 2010/0194795 | A1 * | 8/2010 | Tsuchiya et al. | 347/1 |

* cited by examiner

*Primary Examiner* — Manish S Shah
*Assistant Examiner* — Jeremy Delozier
(74) *Attorney, Agent, or Firm* — Stuart L. Wilkinson

(57) ABSTRACT

A printing apparatus has a series of inkjet print heads spaced from one another in a transport direction. A continuous belt driven around a roller system is used to feed sheet media successively to the print heads so that a partial image printed by one print head is overprinted at a subsequent print head with registration of the partial images. A sheet medium is caused to become electrostatically tacked to the belt by passing the sheet past a charging device. Movement of the belt is tracked by a tracking sub-system and operation of the print heads is coordinated with the tracked belt movement to achieve precise registration of the partial images.

19 Claims, 5 Drawing Sheets

MULTIPLE PRINT HEAD PRINTING APPARATUS AND METHOD OF OPERATION

FIELD OF THE INVENTION

This invention relates to a multiple print head printing apparatus and method of operation and has particular application for transporting sheet media to print zones in such a printer.

DESCRIPTION OF RELATED ART

There is a need for inkjet printers with multiple print heads. Multiple print heads may be required in the transport direction for achieving high sheet processing speeds, printing an image on a sheet with a large number of inks, and printing characters with a greater ink thickness, and therefore colour density or magnetic ink character recognition (MICR) signal strength, than can be achieved with a single print head. Multiple print heads may also be required extending transverse of a direction of paper transport in order to allow printing of an image having a width greater than can be achieved using a single commercially available print head.

With multiple print heads in the transport direction, it may be required that an image printed at a first print head is in exact registration with an image printed at a subsequent print head so that a combined image is achieved. If there is even a slight movement of the print medium, whether arising, for example, from translational movement in the transport or transverse direction, or from the print medium sheet being skewed as it is transferred between the two print heads, then the combined image will be degraded or distorted. The use of an array of multiple inkjet printer heads to create a single combined image where ink from one print head must be precisely positioned in relation to ink from another print head places particular demands on apparatus for transporting sheet media from one print head to another.

Problem-free paper transport arrangements for printers are difficult to achieve especially for individual sheets. Problems that can arise variously with different types of sheet transport arrangement include paper jams, skewed or translationally misplaced images, and lifting or curling of paper away from an underlying platen or belt forming part of the sheet feed arrangement. Many transport systems and methods are known for moving a sheet of paper from an input zone, through a print zone, to an output zone. Generally, such transport systems have a drive arrangement for moving the sheet forward through the zones and a holding means for temporarily holding the sheet to an element of the drive arrangement such as a belt or platen. Well-known sheet transport systems for printers include vacuum systems and roller nips.

A known vacuum system includes a belt to which paper sheets are fed in an orderly sequence at an input zone and from which printed sheets are taken at an output zone. The belt has perforations throughout its length and is driven over an opening to an adjacent air plenum in which a partial vacuum is maintained during the sheet feeding process. The vacuum acts through the perforated belt to suck the paper sheets against the belt. The belt is driven around a roller system to take the vacuum tacked paper sheet from the input zone, past the print zone, to the output zone.

One problem with many vacuum belt systems is that the partial vacuum in the plenum may develop air currents tending to flow around the edge of a transported sheet. The air currents may disturb adjacent air in the gap between the belt and the inkjet print head causing the ink passing across the gap between the print head and the paper to move away from its intended path. This results in the printed image being distorted. This may not be a serious problem where the printed sheet is to be subsequently trimmed to remove a margin region, such being the case, for example, with book printing. However, the problem is more serious in the case of printing checks and other transaction materials where, in order to prevent waste, it is desirable to print sheet materials with no margins, and where the time and equipment involved in an extra trimming step are undesirable.

Another problem with such belt vacuum systems arises from the usual manner of supporting the belt. Normally, the belt is driven over a series of idler rollers which act generally to support the belt throughout its length, but provide specific support immediately adjacent a print head so as to maintain the spacing between the transported sheet and the print head at a precisely desired distance. This means, in practice, that an idler roller must be mounted very close to an associated print head at each print zone. While this is advantageous in terms of a precisely maintained sheet to print head separation, it means that the suction applied to the transported paper sheet to keep it against the belt may be temporarily reduced where the belt passes over a roller. The reduced suction force can result in a region of the paper sheet lifting or curling at the associated print zone which, in turn, can detract from the printed image quality or cause paper jams.

Other known systems for transporting sheet media to be printed have used roller nips, with a roller nip being formed by a pair of rollers mounted with parallel axes of rotation and with the roller surfaces bearing against one another and configured to nip a paper sheet between them as the rollers are rotated in opposite directions. Depending on the particular configuration of sheet transport system, a first roller pair forming a first nip may be mounted upstream of a print zone and be operable to deliver individual sheets to the print zone. Similarly, a second roller pair forming a second nip may be mounted downstream of the print zone and be operable to grip and pull a sheet through and out of the print zone after the sheet has been presented to the print head by the upstream nip. While this may be satisfactory for single print heads, it is problematic for multiple print heads intended to print combined layer images. Because rollers pairs are mounted upstream and downstream of each print zone, it means that in order to accommodate the rollers, the spacing between successive print heads is larger than is desirable. The greater spacing between adjacent print heads coupled with the particular mechanics of the roller nips give greater scope for a sheet of print medium to undergo unwanted movement in its transport between the adjacent print heads. Another problem with roller nips arises particularly in rapid print systems where sheets may be fed at a rate on the order of 700 mm per second. With multiple print heads at this feed rate, there may not be enough time for ink of a first image to dry by the time the sheet is being grabbed by the roller nip to present it to the next print head for overprinting of a second image. If the ink is not dry, then there is a risk that the roller nip will smudge the first image.

SUMMARY OF THE INVENTION

According to one aspect of the invention, there is provided a printer having a plurality of print heads spaced from one another in a transport direction, a transport mechanism comprising a continuous belt of a highly dielectric material for transporting a sheet medium supported on the belt in the transport direction for printing partial images thereon successively by the respective print heads, a charging means to charge the sheet medium to electrostatically tack the sheet medium to the belt, a positioning sub-system to position the belt relative to the print heads, and a control module to coordinate operation of the positioning sub-system with operation of the print heads whereby to obtain a combined image comprising a first partial image printed by a first print head in registration with a second partial image printed by a second print head.

Preferably, the charging means is a brush with conducting bristles connected to a voltage source, the bristles having tips to contact and sweep the surface of the belt as the belt transports the sheet medium. The charging means can be positioned to contact and sweep the surface of the sheet medium transported by the belt. A suitable dielectric material for the belt is Mylar®.

The apparatus can further comprise a plurality of print heads spaced from one another in a direction transverse to the transport direction whereby a wide sheet medium can be printed with partial and combined images.

The positioning sub-system can include sensors to track the position of the belt in the transport and transverse directions. Based on transport direction sensor outputs, signals are generated and sent to the print heads to enable accurate positioning of the printed images. Based on transverse direction sensor outputs, a drive for the belt is adjusted to maintain the transverse position of the belt constant to within an acceptably small tolerance. Preferably, each print head has a respective associated belt support roller, the associated belt support roller located on the distal side of the belt from the print head and supporting the belt at a predetermined spacing from the print head. The belt support rollers can be made of conductive material and may be grounded or held at a potential to minimize electric field strength in the region of the inkjet print heads. A reduced electric field strength reduces the chance of particles being attracted by charge on the sheet medium and belt and so inhibits consequent contamination of the print head area.

The apparatus can further comprise biased electrodes or air current generators adjacent the belt, in each case to direct air borne contaminants that may be attracted by charge on the belt away from the localities of the print heads. The apparatus can further comprise a stripper to strip an electrostatically tacked sheet medium from the belt at an exit zone.

According to another aspect of the invention, there is provided a method of printing for a printer having a plurality of print heads spaced from one another in a transport direction, the method comprising directing a sheet medium onto a continuous belt of a dielectric material, transferring charge to the sheet medium to electrostatically tack the sheet medium to the belt, driving the belt to transport the sheet medium past successive print heads for printing partial images, and coordinating the operation of the successive print heads with tracking the belt to obtain a combined image comprising a first partial image printed by a first print head in registration with a second partial image printed by a second print head.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
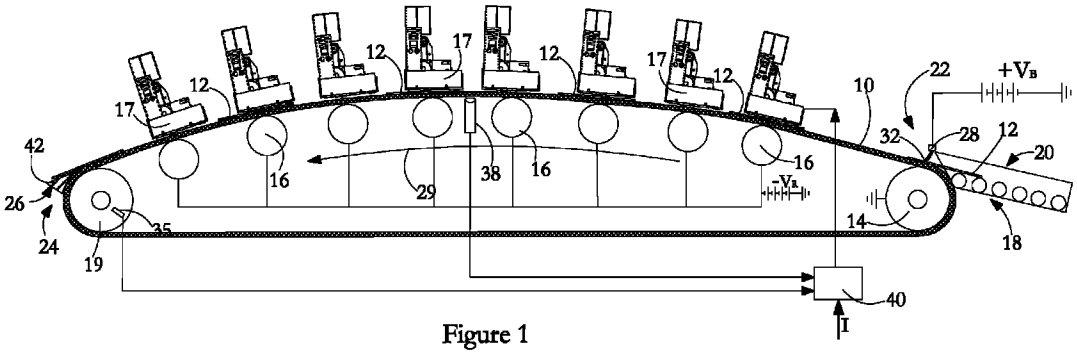
FIG. 1 is a side view of an inkjet printer sheet feed arrangement according to an embodiment of the invention.
Figure 2:
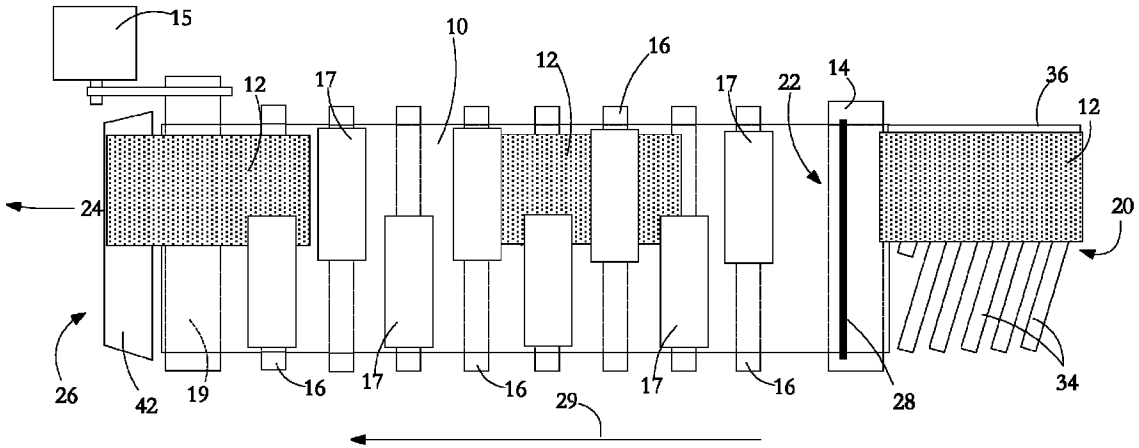
FIG. 2 is a top view of the arrangement of FIG. 1.

Referring in detail to FIG. 1, there is shown a continuous belt 10 for transporting paper sheets 12, the belt being driven by a drive roller 19 around a series of idler rollers 16. At an input zone, shown generally as 18, there is a paper alignment sub-system 20 and a charge transfer sub-system 22. At an output zone shown generally as 24, is a paper sheet stripper arrangement 26. Each of the idler rollers 16 is located adjacent a corresponding inkjet print engine 17. Each print engine 17 contains an inkjet print head 13 and mechanical, electrical and fluidic hardware needed to position and operate the print head. The belt is made of Mylar®, an electrical insulator having a high dielectric strength, the belt having a thickness of the order of 0.13 millimeters. While other belt materials are envisioned, Mylar® is particularly suitable owing to its strength, stiffness, transparency, dielectric strength and low leakage. As shown in FIGS. 1 and 2, the inkjet print engine array comprises eight print engines arranged in two staggered banks of four print engines. As shown in the side view, the print engines of each bank are arranged in a wide diameter arc with each print engine facing the belt where the belt 10 passes over an associated idler roller 16. The idler rollers 16 are maintained at a negative voltage $V_R$ for reasons to be described presently. On the face of each print head 13 are nozzles having exit openings that are spaced from the upper surface of the belt by ½ to 1 millimeter. By tensioning the continuous belt 10 over the arcuate arrangement of rollers 16, the print head to belt spacing is maintained at a comparatively unvarying distance.

As is well-known, inkjet printers operate by ejecting droplets of ink onto a web or sheet medium. Such printers have print heads that are non-contact heads with ink being transferred during the printing process as minute "flying" ink droplets over a short distance of the order of ½ to 1 millimeter. Modern inkjet printers are generally of the continuous type or the drop-on-demand type. In the continuous type, ink is pumped along conduits from ink reservoirs to nozzles. The ink is subjected to vibration to break the ink stream into droplets, with the droplets being charged so that they can be controllably deflected in an applied electric field. In a thermal drop-on-demand type, a small volume of ink is subjected to rapid heating to form a vapour bubble which expels a corresponding droplet of ink. In piezoelectric drop-on-demand printers, a voltage is applied to change the shape of a piezoelectric material and so generate a pressure pulse in the ink and force a droplet from the nozzle. Of particular interest in the context of the present invention are thermal drop-on-demand inkjet print heads commercially available from Silverbrook Research, these being sold under the Memjet trade name which have a very high nozzle density, page wide array and of the order of five channels per print head. Such inkjet print heads have a very high resolution of the order of 1600 dots per inch.

The charge transfer sub-system 22 includes an elongate brush 28 extending transverse to the feed direction. The brush has a series of conducting bristles 30 which are fixed at their upper ends into a conducting housing and which have their lower ends in contact with or close to the upper surface of the paper sheets as they are fed onto the belt 10 at the sheet input zone 18. If the bristles contact paper sheets 12 at the sheet input zone, contact pressure is kept sufficiently low that the sheets are neither damaged nor displaced by the contact. The brush 28 is located close to a grounded conductive roller 14 underlying the belt. The sheets are fed onto the belt by an upstream feed arrangement to be described presently.

In operation, the belt is driven by the roller 19 from a motor 15. The belt tracks around the idler rollers 16 and 14. A potential $V_B$ in the range of +1000 volts to +5000 volts is applied to the brush 28. As a paper sheet 12 is transported by the belt past by the brush 28, charge is transferred from bristle tips 32 to the sheet. The sheet is charged positive and a counter negative charge develops on the underside of the belt owing to the presence of the grounded roller 14. The positive charge on the paper sheets 12, in effect, causes the sheets to be electrostatically "tacked" to the belt. While the exact dynamics of charge transfer to the paper sheets 12 are not fully understood, it is believed that there is at least an element of corona discharge around the tips 32 of the bristles where an intense electric field gradient causes ionization of the air with consequent current passing from the brush to the top surface of the belt. This may be compounded by a triboelectric effect in which charge remains on the paper sheets as contact between such sheets and the bristle tips are broken owing to movement of the belt around the roller system. The highly dielectric nature of the material of the Mylar belt means that charge on the paper sheets 12 does not leak away as the sheets are transported from the input zone to the output zone.

Figure 3:
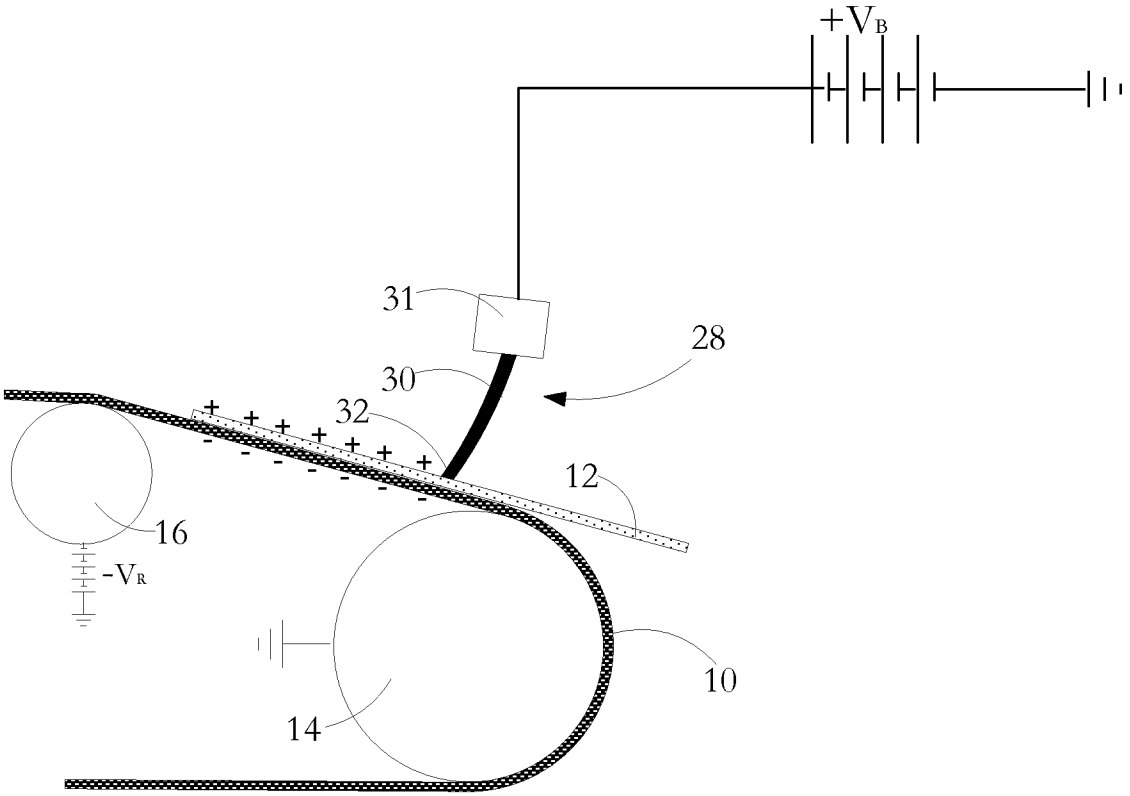
FIG. 3 is a view to a larger scale of a part of the arrangement of FIG. 1 showing a charge transfer brush and its interaction with paper sheets being fed onto a continuous belt for transport past an array of inkjet print heads.
Figure 4:
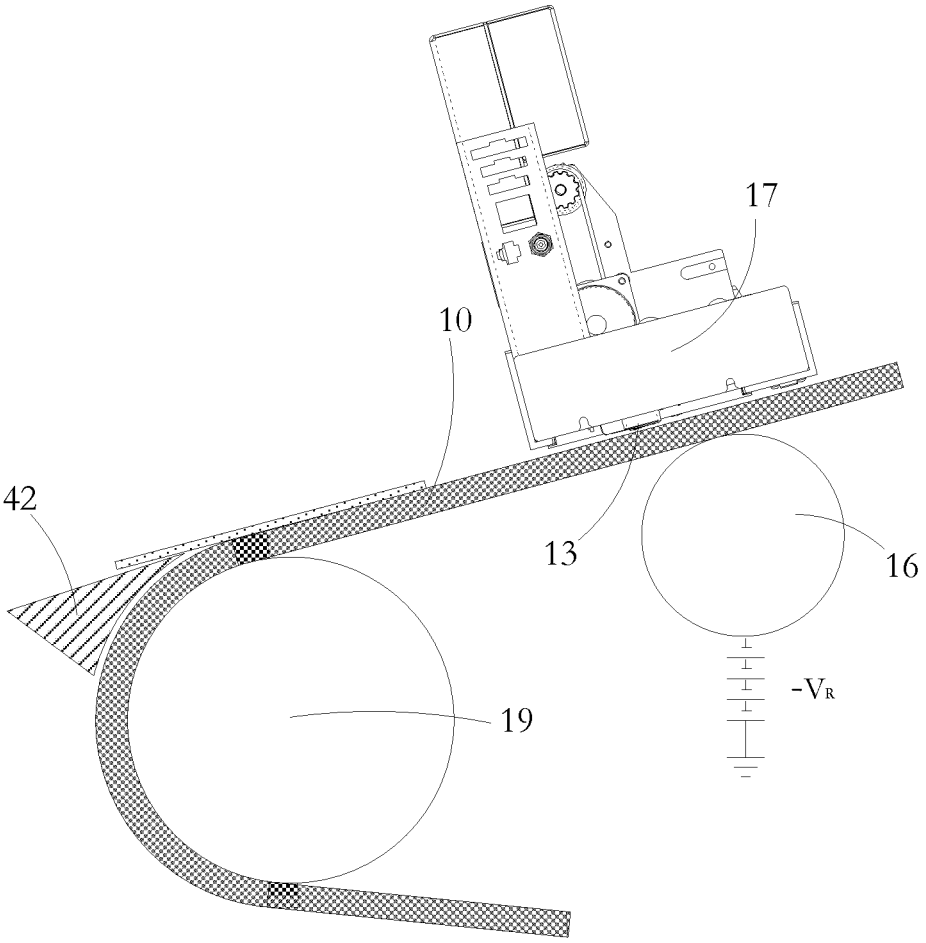
FIG. 4 is a view to a larger scale of a part of the arrangement of FIG. 1 showing a stripper arrangement for stripping an electrostatically tacked paper sheet from a feed belt after a printing process has been completed.

As shown in the scrap view of FIG. 3, the opposite polarity charges—the negative charge at the reverse side of the belt and the positive charge on the paper sheets—set up an attraction which causes the paper sheet to bear against the top surface of the belt. In effect, the paper sheets 12 become electrostatically tacked to the belt.

The paper alignment sub-system 20 is used for initially aligning sheets entering the input zone to a datum and can take any of a number of known forms. The arrangement shown in FIG. 2 has a series of alignment rollers 34 having non-smooth bearing surfaces, the alignment rollers mounted at an angle to the sheet feed direction and a fence 36 aligned with the feed direction. Rectangular paper sheets 12 are transferred into the alignment sub-system generally in an orientation in which they are to pass through the print zones. The inclined rollers 34 are rotated so that a frictional contact between the surfaces of the alignment rollers and the sheets 12 drives the sheets against the fence 36 to more accurately align the sheets with the feed direction. While still under the alignment control of the sub-system 20, leading parts of the sheets pass under the brush 28 and are electrostatically tacked in the then-current position. Other types of feed mechanism for launching sheet media onto the belt may alternatively be used such as a conventional notched wheel driver, the notched wheel having fingers orientated and stiff enough to drive sheets against an alignment edge but sufficiently flexible not to scuff or otherwise damage the sheet media. It will be appreciated that other methods for alignment of sheet media can be used.

The paper alignment sub-system 20 is supplemented by a tracking sub-system which tracks the movement of sheets through the print zone. To ensure accurate positioning of the image on the sheets in the transport direction, the leading edge of each sheet is first detected before the sheet reaches the first print engine in the print engine array. Following this first detection, only the motion of the belt, as accurately measured by a shaft encoder 35 mounted on the belt drive, is used for tracking. Because each sheet is electrostatically tacked to the belt, accurate tracking of the sheets is ensured. Tracking signals from the shaft encoder 35 form inputs to a control module 40, the control module also having an input I comprising the image data for images or partial images to be printed by each of the print engines 17. The control module 40 has outputs (one of which is shown) to each of the print heads which instructs which nozzles of each print head are to be fired and the instant at which each such nozzle is to be fired. The instant of firing of each nozzle is made to depend on the tracking data for that nozzle so that partial images from successive print heads which are to be combined as a single image are in precise registration.

In relation to transverse control, any excursion of the belt in a transverse direction as it is driven through the print zone is monitored by an optical sensor 38 and, based on the sensor output, the idler roller 14 is adjusted to maintain the transverse position of the belt constant to within an acceptably small tolerance. Note that even if accurate initial alignment of sheets is not completely achieved at the sub-system 20 resulting in the sheet having a transverse offset or skew, because the sheet is tacked to the belt, any such offset or skew is unchanged as the sheet is presented to each print engine 17 as it is transported through the print zone. Consequently, component images are subjected to the same offset or skew as they are printed by successive print heads, resulting in an accurately registered combination image.

At the output zone 24, partial stripping of paper sheets 12 from the belt 10 is achieved by using the inherent stiffness of the sheet paper to cause a leading edge portion of a sheet 10 to spring away from the belt 12 as the belt turns through a tight angle at the drive roller 19. Subsequent full stripping of the sheet is achieved by the presence of a stripper bar 42 mounted so that the initially lifted sheet edge portion passes over the top of the bar as the belt passes underneath the bar.

With the invention described, paper sheets are firmly tacked to the belt and so can be accurately transported under the array of inkjet print heads. The multiple print head system can be operated at a very fast sheet processing rate of the order of 700 mm/second or more. Even though multiple overprinted or combined images with highly accurate registration can be achieved using this method, ink deposited on a sheet upper surface is not disturbed as the sheet is transported through successive print zones at the array of print heads.

Generally, accurate transport of sheet media is rendered more difficult if the transport system has to handle papers with a wide range of properties. In terms of surface finish, a sheet may be smooth or rough, and shiny or matt. In terms of thickness and density, the paper may range from tissue paper to card stock. The controllability and accuracy of conventional sheet transport systems, including those described previously, may vary with variation in any or all of these particular sheet paper properties. The apparatus and method described herein can be used effectively with papers and other sheet media having a range of properties, including surface finish, thickness and density.

By electrostatically tacking the paper to the belt, a simplified tracking system can be used which tracks the position and motion of the belt instead of the position and motion of the paper sheets. The belt material is more stable and stiffer than paper. Consequently, it is easier to obtain accurate registration and other handling dynamics over a wider range of papers regardless of paper surface finish, thickness and density.

A potentially adverse effect of maintaining charge on the upper surface of the belt and the induced charge of opposite polarity on the reverse surface of the belt is that contaminants may be attracted to the print heads from the charged paper sheets. This is unwelcome because the contaminants can cause print head nozzles to become blocked. A two stage removal process is utilized. Firstly, contaminants associated with the paper sheets, such as small particulate paper debris, are removed before the sheets are fed to the belt. Such contaminants may, for example, have been introduced during the paper production process and are distributed on the paper surface. Secondly, predominantly air-borne contaminants such as dust are removed from zones surrounding the print heads and the belt before they can settle in the neighbourhood of the print heads and affect the operation of the print head nozzles.

In one exemplary process for paper cleaning, a tacky or polymer roller is run over the paper sheets with the roller periodically being cleaned to detach any build-up of contaminants from the roller surface. This method is supplemented by the use of antistatic ionization bars to neutralize static electricity and reduce cling of debris to the paper surface. In another sheet cleaning method, loose debris is dislodged by means of a brush rotating counter to the paper feed direction, the dislodged debris being immediately subjected to a vacuum to carry the debris away. This method, too, is supplemented by use of the antistatic ionization bars. In yet another method, paper sheets are pre-cleaned with an air knife.

Figure 6:
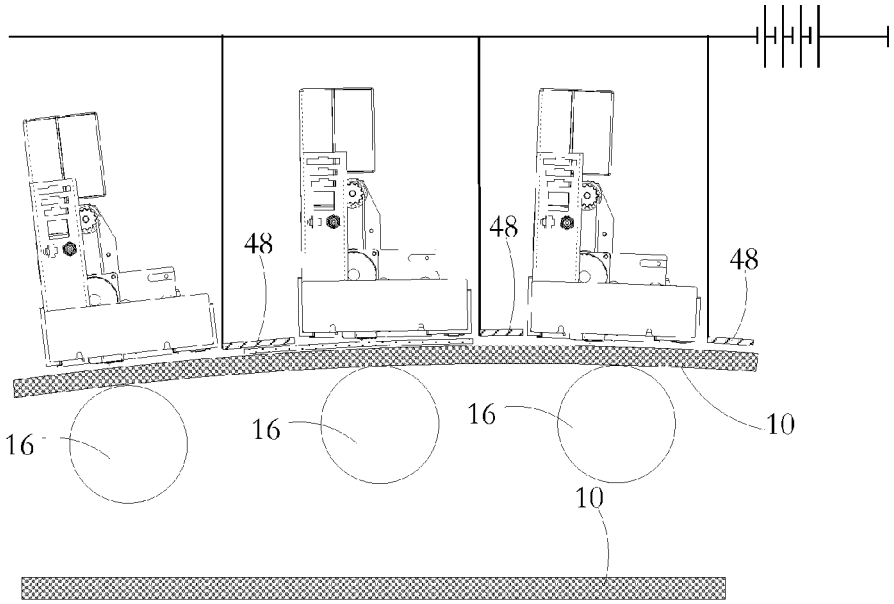
FIG. 6 is a view of a part of the arrangement of FIG. 1 showing another means for inhibiting image deterioration owing to dust attracted towards print heads by the presence of charge on the belt and paper sheets transported by the belt.
Figure 5:
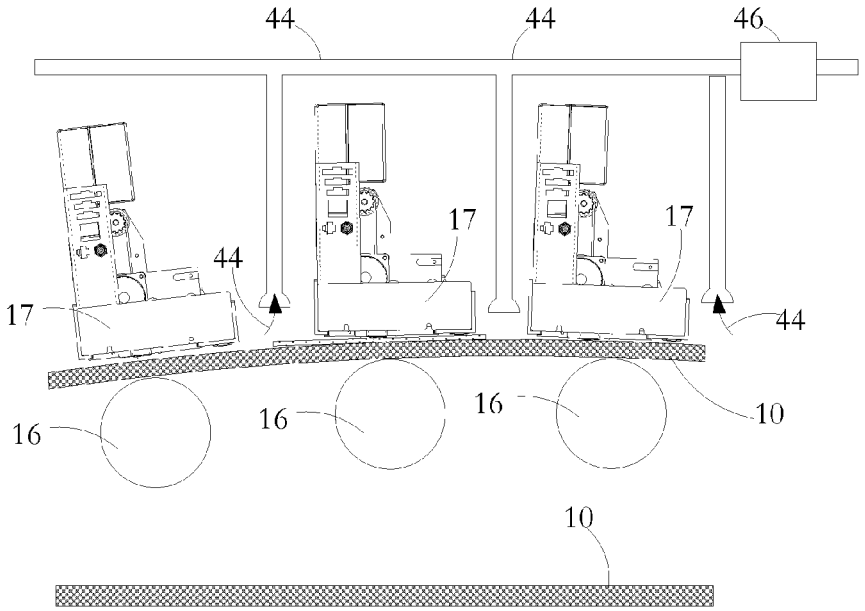
FIG. 5 is a view of a part of the arrangement of FIG. 1 showing one means for inhibiting image deterioration owing to dust attracted towards print heads by the presence of charge on the belt and paper sheets transported by the belt.

For maintaining a clean zone around the print heads, a first method uses, to the extent possible, features of the clean room environment known, for example, from integrated circuit production. In circumstances where a clean room environment is too expensive or otherwise impractical, other methods are used. In one method, a preventative measure is adopted. As previously mentioned, the rollers 16 underlying the belt 10 are held at a negative potential with a voltage sufficient to bring the associated electric field in the region of the print head nozzles to zero. The negative potential neutralizes the field impact of the charged sheets in the region where the ink droplets exit the nozzles and "fly" to the sheets. In one exemplary dust removal technique illustrated in FIG. 5, precisely directed air currents 44 are generated to sweep air-borne dust particles towards filters which are periodically cleaned or replaced. In another method, as shown in FIG. 6, electrodes 48 are positioned at locations where they do not affect the electric field dynamics required to establish the electrostatic tacking, but where they function to attract the dust particles, the attracted dust being periodically removed from the electrodes. The dust particles that are drawn towards charged electrodes are generally not charged positively or negatively, but exist as dipoles. Consequently, a dust electrode 48 attracts one of the poles of a particle. Once attracted, the dust dipole becomes aligned with the electric field produced by the electrode and so the dust particle as a whole is attracted to the dust electrode.

While the sheet paper transfer system of the invention has been described in relation to a series of inkjet print heads, it will be appreciated that the transfer system can be implemented with other print heads such as laser print heads.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. Ink jet printing apparatus comprising a continuous belt of dielectric material, a launch mechanism to launch a sheet medium onto the surface of a section of the belt, a charge transfer arrangement for transferring electrical charge to the sheet medium as it is launched onto the belt section and to induce charge of opposite polarity on the reverse surface of the belt section, whereby the sheet medium is held on the belt section by a combination of the weight of the sheet medium and electrostatic attraction between the sheet medium and the belt section, a drive for driving the belt section with the sheet medium held thereon in a generally horizontal transport direction past ink jet print heads spaced from one another in the transport direction, the print heads arranged for printing downwardly onto the sheet medium supported on the belt section, a tracking sub-system for tracking movement of the belt, and a control module to coordinate operation of the print heads with the tracked movement of the belt whereby, in a single pass of the belt section past the print heads, to obtain a combined image comprising a first partial image printed by a first print head in registration with a second partial image printed by a second print head.

2. Apparatus as claimed in claim 1, the charging means being a brush with conducting bristles connected to a voltage source, the bristles having tips for transferring charge to the sheet medium as the transported sheet medium passes the brush.

3. Apparatus as claimed in claim 2, the charging means positioned to contact and sweep the surface of the sheet medium as the sheet medium is launched onto the belt section.

4. Apparatus as claimed in claim 1, the dielectric material being Mylar®.

5. Apparatus as claimed in claim 1, further comprising a plurality of print heads spaced from one another in a direction transverse to the transport direction.

6. Apparatus as claimed in claim 1, the tracking sub-system for tracking movement of the belt in the transport direction.

7. Apparatus as claimed in claim 6, further comprising a sensor for sensing a leading edge of the sheet medium as the sheet medium is launched onto the belt section.

8. Apparatus as claimed in claim 6, the tracking sub-system additionally for tracking movement of the belt in a direction transverse to the transport direction.

9. Apparatus as claimed in claim 1, each print head having a respective associated belt support roller, the associated belt support roller located on the distal side of the belt from the print head and supporting the belt at a predetermined spacing from the print head.

10. Apparatus as claimed in claim 9, the belt support roller held at a potential such that electric field strength at a region immediately adjacent nozzles of the associated print head is substantially zero.

11. Apparatus as claimed in claim 9, the belt having generally planar sections extending between adjacent belt support rollers, the plane of the belt section immediately upstream of a belt support roller angled relative to the plane of the belt section immediately downstream of the said belt support roller.

12. Apparatus as claimed in claim 1, further comprising an inhibitor to inhibit contaminants from entering a region adjacent to the nozzles of each print head.

13. Apparatus as claimed in claim 12, the inhibitor being at least one biased electrode adjacent the belt intermediate successive print heads.

14. Apparatus as claimed in claim 12, the inhibitor being at least one air current generator adjacent the belt intermediate successive print heads.

15. Apparatus as claimed in claim 1, further comprising a cleaning sub-system to clean the sheet medium before it enters an input zone of the belt.

16. Apparatus as claimed in claim 1, further comprising a stripper to strip an electrostatically tacked sheet medium from the belt at an exit zone.

17. Apparatus as claimed in claim 16, the stripper being a mechanical stripper having a stripping roller around which the belt passes, the sheet medium, owing to its inherent stiffness, departing from the profile of the stripping roller to initiate separation of the sheet medium from the belt as the belt tracks over the stripping roller.

18. Apparatus as claimed in claim 17, the stripper further including a bar positioned adjacent the belt at said stripping roller to receive an initially separated part of the sheet medium and to cause further separation as the remaining tacked part of the sheet medium is driven in the transport direction by the belt.

19. An ink jet printing method comprising launching a sheet medium onto the surface of a section of a continuous belt of dielectric material, transferring electrical charge to the sheet medium as it is launched onto the belt section to induce charge of opposite polarity on the reverse surface of the belt section, whereby the sheet medium is held on the belt section by a combination of the weight of the sheet medium and electrostatic attraction between the sheet medium and the belt section, driving the belt section with the sheet medium held thereon in a generally horizontal transport direction past ink jet print heads spaced from one another in the transport direction, the print heads arranged to print downwardly onto the sheet medium supported on the belt section, operating the print heads successively to coordinate printing by the print heads in a single pass of the belt section past the print heads to obtain a combined image comprising a first partial image printed by a first print head in registration with a second partial image printed by a second print head.

* * * * *